US009725984B2

(12) United States Patent
Fripp et al.

(10) Patent No.: US 9,725,984 B2
(45) Date of Patent: Aug. 8, 2017

(54) WELLBORE SYSTEMS WITH ADJUSTABLE FLOW CONTROL AND METHODS FOR USE THEREOF

(71) Applicant: Halliburton Energy Services, Inc., Houston, TX (US)

(72) Inventors: Michael Fripp, Carrollton, TX (US); John Gano, Carrollton, TX (US); Scott Cunningham, Grapevine, TX (US); Stephen Michael Greci, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 376 days.

(21) Appl. No.: 14/388,253

(22) PCT Filed: Nov. 27, 2013

(86) PCT No.: PCT/US2013/072114

§ 371 (c)(1),
(2) Date: Sep. 26, 2014

(87) PCT Pub. No.: WO2015/080712

PCT Pub. Date: Jun. 4, 2015

(65) Prior Publication Data

US 2016/0251936 A1 Sep. 1, 2016

(51) Int. Cl.
*E21B 43/08* (2006.01)
*E21B 43/12* (2006.01)
(Continued)

(52) U.S. Cl.
CPC ..... *E21B 34/06* (2013.01); *E21B 34/08* (2013.01); *E21B 43/12* (2013.01); *E21B 43/16* (2013.01);
(Continued)

(58) Field of Classification Search
CPC ..... E21B 43/08; E21B 43/12; E21B 34/08
(Continued)

(56) References Cited

U.S. PATENT DOCUMENTS 2,342,273 A * 2/1944 Hayward ..... E21B 49/005 250/485.1
2008/0283238 A1 11/2008 Richards et al.
(Continued)

FOREIGN PATENT DOCUMENTS

WO 2015080712 A1 6/2015

OTHER PUBLICATIONS

International Search Report and Written Opinion for PCT/US2013/072114 dated Aug. 26, 2014.

*Primary Examiner* — Cathleen Hutchins
(74) *Attorney, Agent, or Firm* — McDermott Will & Emery LLP

(57) ABSTRACT

It is sometimes desirable to differentially regulate fluid flow in a subterranean formation using autonomous inflow control devices (AICDs), but they are not readily configurable in the field at present. Wellbore systems providing adjustable flow control may comprise: a wellbore pipe having a flow control assembly fixedly coupled thereto, the wellbore pipe having an interior space, an outer surface, and one or more AICDs establishing a fluid connection between the interior space and the outer surface of the wellbore pipe, and the flow control assembly comprising one or more flow chambers defined on the outer surface about the one or more AICDs, one or more inlets being fluidly connected to the one or more flow chambers; wherein the one or more inlets are configured to accept a plug for occluding fluid flow therethrough, so as to limit access of a fluid to an entry location of the AICDs.

22 Claims, 8 Drawing Sheets

(51) Int. Cl.

| | |
|---|---|
| ***E21B 34/08*** | (2006.01) |
| ***E21B 34/06*** | (2006.01) |
| ***E21B 43/16*** | (2006.01) |
| *E21B 34/00* | (2006.01) |

(52) U.S. Cl.
CPC ..... *E21B 43/08* (2013.01); *E21B 2034/007* (2013.01)

(58) Field of Classification Search
USPC ..... 137/92
See application file for complete search history.

(56) References Cited

U.S. PATENT DOCUMENTS

| | | | | |
|---|---|---|---|---|
| 2009/0151925 | A1 | 6/2009 | Richards et al. | |
| 2009/0229823 | A1* | 9/2009 | Moen | E21B 43/088 166/302 |
| 2011/0186300 | A1* | 8/2011 | Dykstra | E21B 34/08 166/316 |
| 2011/0198097 | A1 | 8/2011 | Moen | |
| 2013/0220632 | A1 | 8/2013 | Greci et al. | |
| 2013/0299198 | A1 | 11/2013 | Gano et al. | |

* cited by examiner

WELLBORE SYSTEMS WITH ADJUSTABLE FLOW CONTROL AND METHODS FOR USE THEREOF

BACKGROUND

The present disclosure generally relates to fluid flow regulation in a subterranean formation, and, more specifically, to wellbore systems with adjustable flow control and methods for their deployment during operations in a subterranean formation.

It can often be beneficial to regulate the flow of formation fluids within a wellbore penetrating a subterranean formation. A variety of conditions and/or intended purposes can necessitate such flow regulation including, for example, preventing water and/or gas coning, minimizing water and/or gas production, minimizing sand production, maximizing oil production, balancing production from various subterranean zones, equalizing pressure among various subterranean zones, and/or the like.

Likewise, regulation of the flow of injection fluids such as, for example, water, steam or gas, within a wellbore can also sometimes be desirable. Flow regulation of an injection fluid can be particularly useful, for example, to control the distribution of the injection fluid within various subterranean zones and/or to prevent the introduction of the injection fluid into currently producing zones.

A number of different types of flow resistance systems have been developed in order to meet the foregoing needs. Many flow resistance devices can variably occlude the passage of some fluids more than others based upon one or more physical property differences between the fluids. Illustrative physical properties of a fluid that can determine its rate of passage through a variable flow resistance system can include, for example, viscosity and density. Variable flow resistance systems can promote the passage of enhanced ratios of a desired fluid to an undesired fluid through a flow pathway containing the variable flow resistance system compared to that obtained when the variable flow resistance system is not present. Many variable flow resistance devices function autonomously as a consequence of their design and will be referred to herein as autonomous inflow control devices (AICDs), a number of which will be familiar to one having ordinary skill in the art. Many AICDs function by inducing rotational motion in a fluid, such that lower viscosity fluids experience a longer transit time therethrough than do more viscous fluids, such as oil or a like hydrocarbon resource. Other AICDs function by inducing movement of a moveable plate or a moveable piston in the fluid, such that a lower viscosity or lower density fluid experiences a reduced flow pathway. Still other AICDs function by restricting the flow of a higher viscosity fluid, such as water, compared to a lower viscosity fluid, such as gas. The preferential passage of oil or a like hydrocarbon resource through an AICD can allow enhanced production from a subterranean formation to be realized. AICDs may be used in other subterranean operations as well, not just during the production stage.

Although AICDs can be used with considerable success during subterranean operations, there are some challenges associated with their use that are not readily addressed at present. Most often, a set number of AICDs are housed in a flow control assembly that is coupled to the outer surface of a wellbore pipe, which may also be referred to herein as production tubing or completion tubing. Accordingly, flow regulation using AICDs is presently an all or nothing venture for a well operator, at least without considerable and costly manufacturing alterations to produce custom flow control assemblies with a desired number of AICDs. At present, a well operator is unable to modify an AICD configuration in the field if last minute changes are desired based on a change in the well condition.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, as will occur to one having ordinary skill in the art and the benefit of this disclosure.

DETAILED DESCRIPTION

Figure 1:
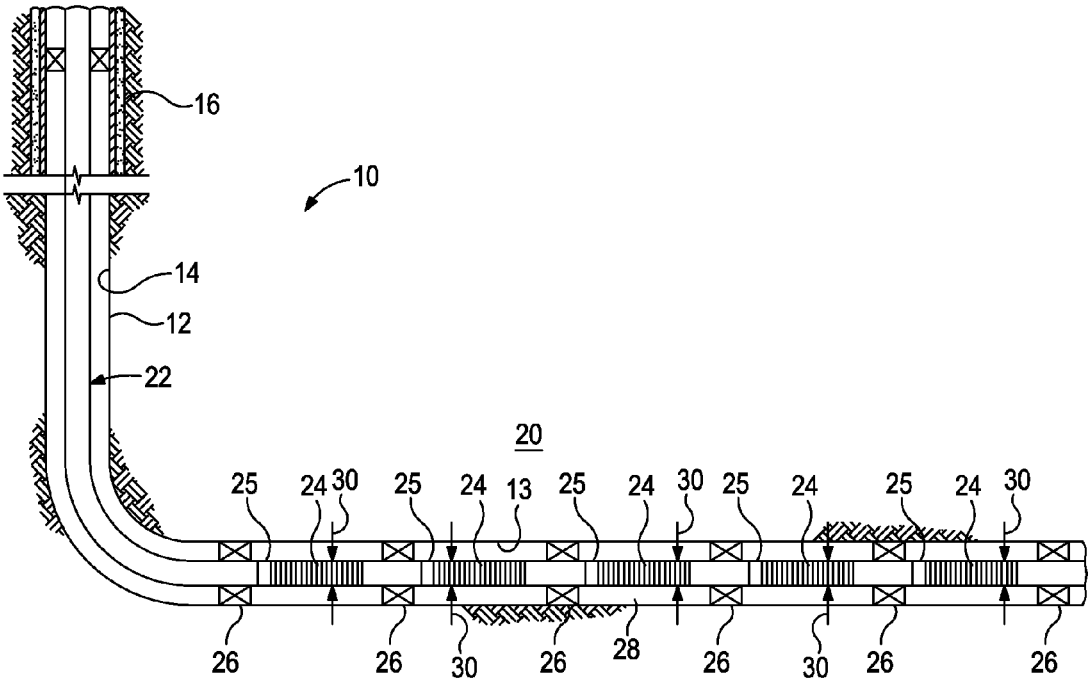
FIG. 1 shows an illustrative schematic of a wellbore system including a plurality of flow control assemblies, each containing a plurality of AICDs.

The present disclosure generally relates to fluid flow regulation in a subterranean formation, and, more specifically, to wellbore systems with adjustable flow control and methods for their deployment during operations in a subterranean formation.

Illustrative embodiments incorporating the disclosure herein are presented below. Not all features of a physical implementation are described or shown in this application for the sake of clarity. It is to be understood that in the development of a physical embodiment incorporating the embodiments of the present disclosure, numerous implementation-specific decisions may be made to achieve the developer's goals, such as compliance with system-related, business-related, government-related and other constraints, which vary by implementation and from time to time. While a developer's efforts might be time-consuming, such efforts would be, nevertheless, a reasonable, routine undertaking for one having ordinary skill in the art and the benefit of this disclosure.

While systems and methods are described herein in terms of "comprising" various components or steps, the systems and methods can also "consist essentially of" or "consist of" the various components and steps. Unless otherwise indicated, all numerical quantities expressed herein are to be understood as being modified in all instances by the term "about." Accordingly, unless indicated to the contrary, the numerical parameters set forth in the following specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

Although AICDs and other flow resistance devices can be used with considerable success in various subterranean operations, particularly during production of oil or another hydrocarbon resource, off-the-shelf flow control assemblies containing AICDs can sometimes be insufficient or sub-optimal for performing a particular job. For example, once a well has been drilled and logged, it may be the case that the AICD configuration originally planned for use in the wellbore is, in fact, rather unsuitable for the conditions that are actually present. At the very least, even if a flow control assembly with a suitable AICD configuration exists, delays in shipping it to a job site can represent a significant time and expense issue. Manufacturing a flow control assembly with a customized AICD configuration suited for performing a particular job represents an even greater time and expense concern.

Flow control assemblies are typically made with a few set configurations of AICDs and are stockpiled by a manufacturer. The flow control assemblies are then coupled to a wellbore pipe at a job site. The embodiments of the present disclosure advantageously allow one to readily modify existing (i.e., off-the-shelf) flow control assemblies containing one or more AICDs in order to produce a customized degree of flow regulation in response to conditions that are actually present in a well. More specifically, the embodiments described herein allow a flow pathway to or from an AICD to be readily accessed and occluded, if necessary, before a flow control assembly is placed downhole. By modifying existing flow control assemblies in accordance with the embodiments described herein, a limited number of generic AICD configurations can still be constructed and stockpiled by a manufacturer. Flow control assemblies with access to their flow pathways for on-site customization can be realized with minimal changes in their present design, as discussed hereinafter. Such flow control assemblies can then be tailored at a job site to meet the requirements posed by a particular set of downhole conditions.

Before further discussing how flow control assemblies containing AICDs may be modified to realize the above features, a brief discussion of wellbore systems capable of producing flow control in a subterranean formation will be provided. FIG. 1 shows an illustrative schematic of wellbore system 10 including a plurality of flow control assemblies 25, each potentially containing one or more AICDs. As depicted in FIG. 1, wellbore 12 has generally vertical uncased section 14 extending downwardly from casing 16, as well as generally horizontal uncased section 13 extending through subterranean formation 20. Wellbore pipe 22 (e.g., production tubing or completion tubing) is installed in wellbore 12. Interconnected to wellbore pipe 22 and making a fluid connection therewith are multiple well screens 24 and flow control assemblies 25, the latter containing a plurality of AICDs. Packers 26 seal off annulus 28 formed radially between the wellbore pipe 22 and uncased section 13. In this manner, fluids 30 may be produced from multiple intervals or zones of subterranean formation 20 via isolated portions of annulus 28 between adjacent packers 26.

Positioned between adjacent packers 26 are well screen 24 and flow control assembly 25, which form a fluid connection to the interior of wellbore pipe 22. Well screen 24 filters fluids 30 flowing from annulus 28 into the interior of wellbore pipe 22, thereby protecting the components of flow control assembly 25, which lies downstream of well screen 24. Flow control assembly 25 variably restricts the flow of fluids 30 into the interior of wellbore pipe 22, based on certain physical properties of the fluids and their interaction with the AICDs housed therein. Suitable well screens 24 will be familiar to one having ordinary skill in the art and may include, but are not limited to, swell screens, wraps, meshes, sintered screens, fiber mats, granular filters, resin coated sand, and the like. Further disclosure regarding the orientation and configuration of flow control assembly 25 in wellbore system 10 follows below.

It should be noted that wellbore system 10 represents merely one example of a wide variety of wellbore systems in which the various aspects of this disclosure can be implemented. It should be clearly understood that the principles of this disclosure are not limited to the details of wellbore system 10 or its depicted components. For example, it is not necessary that wellbore 12 include generally vertical uncased wellbore section 14 or generally horizontal uncased wellbore section 13. It is also not necessary for well screens 24, flow control assemblies 25, packers 26 or any other components to be positioned in a cased or uncased section of wellbore 12. Any section of wellbore 12 may be cased or uncased, and any portion of wellbore pipe 22 or any component extending therefrom may be positioned in an uncased or cased section of wellbore 12 in keeping with the principles of this disclosure.

Zonal isolation with packers 26 is also not required. However, it will be appreciated by one having ordinary skill in the art that zonal isolation can be beneficial to regulate the flow of fluids 30 into the interior of wellbore pipe 22 from each zone of subterranean formation 20 to prevent water coning or gas coning, for example. Other instances in which zonal isolation can be desirable include, but are not limited to, balancing production from (or injection into) multiple zones, minimizing or maximizing production or injection of undesired fluids, and the like. Hence, it is also not necessary for fluids 30 to only be produced from subterranean formation 20 since, in other examples, fluids can be injected into subterranean formation 20 and subsequently be produced therefrom. Specifically, injecting a fluid into subterranean formation 20 may comprise injecting the fluid through wellbore pipe 22, such that the fluid being injected flows from wellbore pipe 22 through flow control assembly 25 in a direction opposite that to which a fluid flows during production operations.

It is further not necessary for a single flow control assembly 25 to be used in conjunction with a single well screen 24. Any number, arrangement and/or combination of these components may be used. Moreover, in some embodiments, well screen 24 may be omitted, if desired. For example, in injection operations, an injected fluid may be flowed through flow control assembly 25 without also flowing through a well screen.

Figure 2:
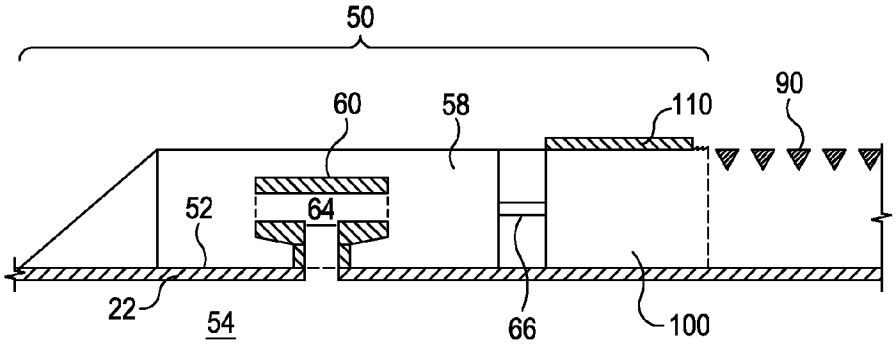
FIGS. 2 and 3 show illustrative schematics of a section of a wellbore pipe having a flow control assembly coupled to an outer surface of the wellbore pipe.
Figure 3:
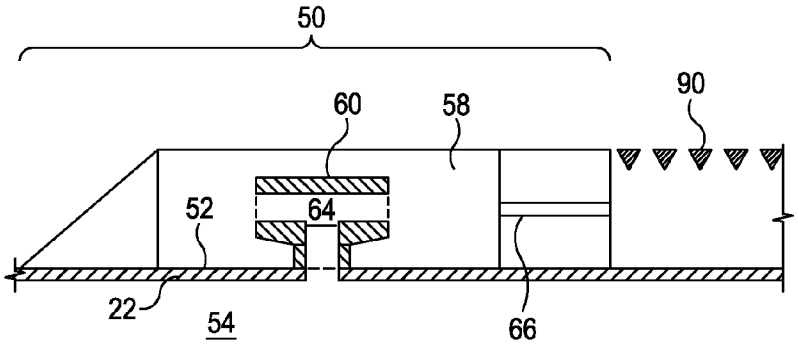

Flow control assemblies coupled to the outer surface of a wellbore pipe and providing an operator access locations for occluding fluid flow within the flow control assemblies will now be described in more detail. With continued reference to FIG. 1, FIGS. 2 and 3 show illustrative schematics of a section of wellbore pipe 22 having flow control assembly 50 coupled to outer surface 52 of wellbore pipe 22. AICD 60 is affixed to wellbore pipe 22 within flow chamber 58 of flow control assembly 50 and establishes a fluid connection to interior space 54 of wellbore pipe 22 via flow path 64.

Inlet 66 is fluidly connected to flow chamber 58 and allows a fluid to enter AICD 60. Although FIG. 2 has only depicted one flow chamber 58, AICD 60 and inlet 66, it is to be recognized that any number of these components may be present and circumferentially distributed about wellbore pipe 22. For example, between 1 and about 100 flow chambers may be circumferentially distributed about wellbore pipe 22 in various embodiments. Any number of inlets 66 may be occluded according to the embodiments described herein in order to regulate fluid flow to a desired degree, as described hereinbelow. Moreover, although FIGS. 2 and 3 have depicted inlet 66 as being fluidly connected to only a single flow chamber 58, it is to be recognized that a single inlet 66 may feed multiple flow chambers 58, if present, through branching of inlet 66. Likewise, in some embodiments, multiple inlets 66, if present, may feed a single flow chamber 58. In some embodiments, each flow chamber 58 may be fed by a single inlet 66, as depicted in FIGS. 2 and 3.

In some embodiments, AICD 60 can differentially influence the flow rate of a fluid passing therethrough by inducing rotational motion in one or more components of the fluid. The design and function of AICDs, particularly AICDs capable of inducing rotational motion in a fluid, will be familiar to one having ordinary skill in the art, and these components will not be described herein in any significant detail. Even though AICD 60 may be quite complex in structure, the simplified renditions of the FIGURES will be sufficient for one having ordinary skill in the art to gain an understanding of the embodiments described herein.

Referring still to FIG. 2, well screen 90 may be fluidly coupled to flow control assembly 50 via flow channel 100. Specifically, well screen 90 is located upstream of inlet 66, whereby flow channel 100 is defined between an entrance to inlet 66 and well screen 90. When flow control assembly 50 is utilized in conventional flow control operations without modification of a fluid flow rate therethrough, there is ordinarily no reason to access flow channel 100. However, in the embodiment depicted in FIG. 2, flow channel 100 is enclosed by movable cover 110 located over at least a portion of flow channel 100, which forms a fluid seal thereover. In some embodiments, movable cover 110 may be a sliding sleeve, which may allow an operator to gain access to flow channel 100 in order to insert plugs into inlet 66, as described in further detail below. In other embodiments, access to flow channel 100 may be gained by alternative structures such as, for example, a swinging panel, an access port, a mechanically fastened plate (e.g., using one or more mechanical fasteners, such as bolts, screws, pins, snap rings, and the like), combinations thereof, and the like. In embodiments where an operator does not need to axially access inlet 66, well screen 90 may be directly coupled to flow control assembly 50 by omitting flow channel 100 and its associated movable cover 110, as depicted in FIG. 3.

In some embodiments, movable cover 110 may be a sliding sleeve that is movably coupled to flow control assembly 50 or well screen 90, such that the sliding sleeve can move laterally with respect to wellbore pipe 22, thereby allowing access to be gained to flow channel 100. In various embodiments, the sliding sleeve may be threaded to allow such lateral movement to take place. Sliding sleeve technology will be familiar to one having ordinary skill in the art and may be readily incorporated in a wellbore system by one having such knowledge and the benefit of the present disclosure.

According to various embodiments of the present disclosure, inlet 66 may be occluded in order to decrease the amount of a fluid passing to a corresponding AICD 60 within flow chamber 58. The terms "block," "restrict," and "plug" and variants thereof may be used synonymously herein with the term "occlude" and variants thereof to indicate a decreased rate of fluid flow. These terms do not necessarily refer to the complete stoppage of fluid flow. Any number of inlets 66 may be occluded when more than one is present. In various embodiments, the occlusion of inlet 66 may take place before wellbore pipe 22 and flow control assembly 50 are positioned in a subterranean formation. That is, modification of inlet 66 may take place on or near the earth's surface once a well operator determines the extent to which fluid exposure to AICD 60 needs to be altered.

When multiple inlets 66 feed a single flow chamber 58, each inlet 66 may be occluded in some embodiments. In other embodiments, only some of inlets 66 may be occluded, such that the fluid flow rate to a particular AICD 60 is decreased but not completely shut off.

Figure 4:
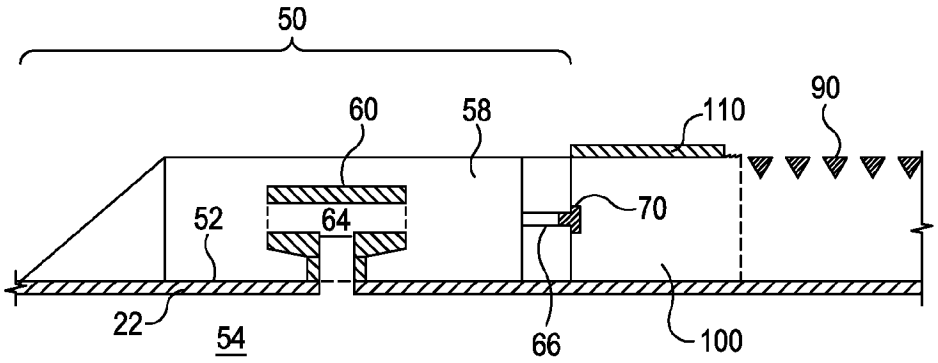
FIGS. 4-6 show illustrative schematics demonstrating how the inlets in FIGS. 2 and 3 may be occluded with a plug.
Figure 5:
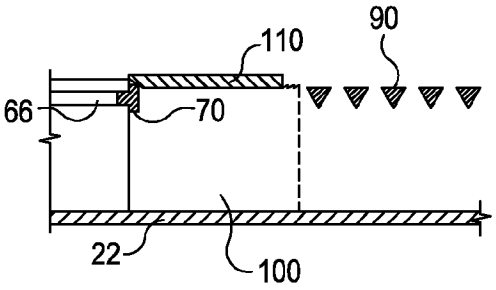
Figure 6:
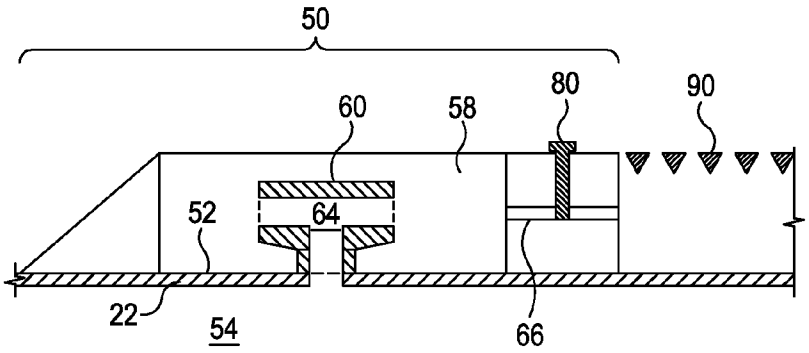

FIGS. 4-6 show illustrative schematics demonstrating how inlets 66 in FIGS. 2 and 3 may be occluded with a plug. As depicted in FIG. 4, the occlusion of inlet 66 may take place with axially inserted plug 70 that is inserted at least partway into inlet 66 along its longitudinal axis. As a result, fluid flow through inlet 66 to AICD 60 is decreased or eliminated, thereby lowering the overall fluid discharge into interior space 54. Access to inlet 66 may be gained through movable cover 110 to allow placement of axially inserted plug 70 in inlet 66. An advantage of regulating fluid flow with axially inserted plug 70 in the manner depicted in FIG. 4 is that presently available flow control assemblies 50 may be readily modified to incorporate movable cover 110 in the indicated location.

When movable cover 110 is a sliding sleeve, the sliding sleeve may be configured to hold axially inserted plug 70 in place when the sliding sleeve is engaged. FIG. 5 shows an expansion of FIG. 4 in the region of flow channel 100, demonstrating how movable cover 110 in the form of a sliding sleeve may be configured to engage axially inserted plug 70 within inlet 66 by moving laterally with respect to wellbore pipe 22 over a threaded region. In the interest of clarity, components downstream of inlet 66 as well as well screen 90 have not been depicted in FIG. 5. As shown in FIG. 5, when the sliding sleeve is closed, it engages axially inserted plug 70, thereby substantially locking it into place.

Similarly, FIG. 6 shows that occlusion of inlet 66 may take place with radially inserted plug 80, which is inserted from the exterior of flow control assembly 50 to inlet 66. In FIG. 6, axial access is not needed for access to occlude inlet 66, and flow channel 100 and movable cover 110 have been omitted from this FIGURE, although they may be present at an operator's discretion. Even when not actively occluding inlet 66, radially inserted plug 80 may remain disposed in the opening extending to inlet 66 in order to prevent unwanted fluid loss through the opening in which radially inserted plug 80 is housed. Specifically, when it is not desired to occlude fluid flow within inlet 66, radially inserted plug 80 may remain in place but not be fully engaged in its opening such that inlet 66 remains unblocked. An opening in which radially inserted plug 80 may be inserted may be introduced through minor modifications of existing flow control assembly designs and manufacturing processes, thereby allowing flow modification to take place at the discretion of a well operator. An advantage of using radially inserted plug 80 to regulate fluid flow through inlet 66 is that radially inserted plug 80 can be accessed exteriorly, even when flow control assembly 50 is coupled to wellbore pipe 22. Moreover, by only partially inserting plug 80 into inlet 66, some degree of fluid flow regulation may be achieved without completely shutting off flow, as may be more prevalent when axially blocking inlet 66. The ability to decrease fluid flow to one or more circumferentially distributed AICDs 60 may beneficially help balance the distribution of flow entering wellbore pipe 22. Alternately, a shorter version of plug 80 may be inserted such that it shoulders on flow control assembly 50 but does not even partially occlude inlet 66. There may be a plurality of different lengths for plug 80 in order to achieve a desired degree of flow restriction.

In some embodiments, both axially inserted plugs 70 and radially inserted plugs 80 may be inserted into the same flow control assembly 50, particularly when multiple inlets 66 are present. In some embodiments, axially inserted plugs 70 and radially inserted plugs 80 may be inserted into the same inlet 66, and in other embodiments, some inlets 66 may contain axially inserted plugs 70 while other inlets 66 contain radially inserted plugs 80. It is to be further recognized that the number of inlets 66 occluded with plugs 70 or 80 and the manner in which they are occluded may depend upon particular conditions encountered at a job site, and the determination of a suitable configuration for occluding fluid flow may be made by one having ordinary skill in the art and the benefit of the present disclosure.

The manner in which plugs 70 and 80 engage inlet 66 is not believed to be particularly limited. In various embodiments, plugs 70 and 80 can be a threaded rod (e.g., a threaded rod conforming to National Pipe Thread (NPT) specifications). In some embodiments, a fluid seal may be maintained with an O-ring assembly, metal-to-metal plugs, or like means for maintaining a fluid seal. Other techniques for maintaining an appropriate fluid seal can be envisioned by one having ordinary skill in the art and the benefit of this disclosure.

The embodiments depicted in FIGS. 4-6 have each shown blocking the access of a fluid to flow chamber 58 from a location "upstream" of AICD 60. In those depicted embodiments, there is no "downstream" access location to inlet 66 to allow insertion of a plug from that direction. However, flow control assembly 50 may be modified to provide such access as another means for occluding fluid flow, as described hereinafter. In some embodiments, the previously described "upstream" fluid flow occlusion may be used in combination with "downstream" fluid flow occlusion by combining the various embodiments described individually herein.

Figure 7A:
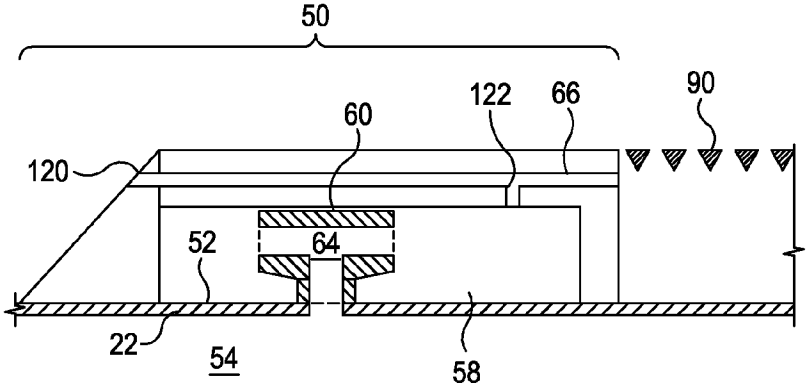
FIGS. 7A and 7B show illustrative schematics of exemplary configurations of a flow control assembly in which an inlet extends beyond a flow chamber therein and defines a backside opening on the flow control assembly.
Figure 7B:
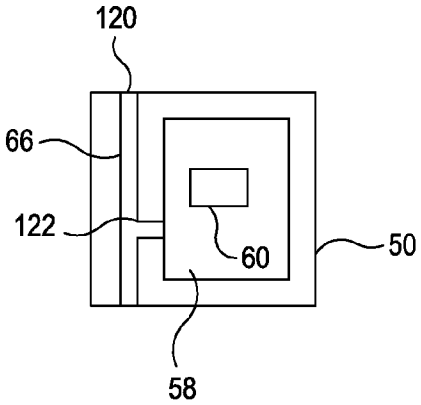

FIGS. 7A and 7B show illustrative schematics of exemplary configurations of flow control assembly 50 in which inlet 66 extends beyond flow chamber 58 and defines backside opening 120 on flow control assembly 50. That is, inlet 66 extends completely through the housing of flow control assembly 50. Another difference in FIGS. 7A and 7B compared to the previously depicted embodiments is the way in which a fluid gains access to flow chamber 58 from inlet 66. Specifically, in FIGS. 7A and 7B, a fluid exits inlet 66 via its sidewall at location 122 rather than its end in entering flow chamber 58. Further differences in occluding fluid flow in inlet 66 with the configuration of FIGS. 7A and 7B are described hereinbelow in reference to FIGS. 8A, 8B and 9. It is to be noted that flow channel 100 has been omitted from FIGS. 7A and 7B, since axial access to inlet 66 is gained from backside opening 120. However, in some embodiments, flow channel 100 may optionally be present even in configurations where a backside opening 120 is present. The other previously depicted and described components may also be present as well, including but not limited to well screen 90.

As depicted in FIG. 7A, in one embodiment, inlet 66 may be radially offset from flow chamber 58, such that a fluid enters flow chamber 58 from its top via location 122, although this embodiment may take up more radial space than subsequently described embodiments. In other embodiments, inlet 66 may be offset to the side of flow chamber 58, as depicted in the top view schematic of FIG. 7B. The exemplary configuration of FIG. 7B may be particularly desirable so that the radial footprint of flow control assembly 50 is not appreciably changed when coupled to wellbore pipe 22. Further description of how fluid flow may be occluded through inlet 66 is provided below in reference to FIGS. 8A, 8B and 9. Regardless of the disposition of inlet 66, the occlusion of fluid flow therethrough may take place similarly via backside opening 120.

Figure 8A:
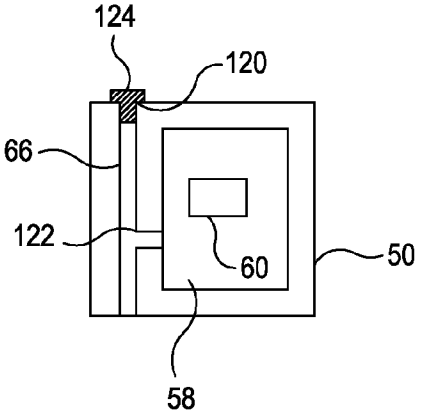
FIGS. 8A and 8B show expansions of an inlet and backside opening in configurations without (FIG. 8A) and with (FIG. 8B) fluid flow occlusion.
Figure 8B:
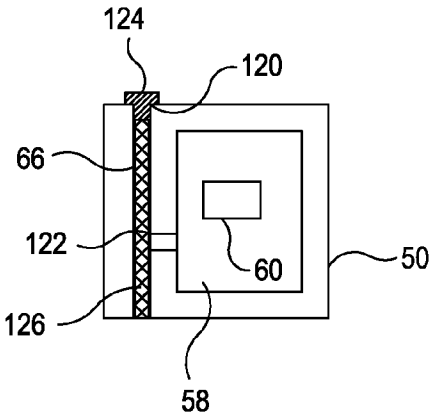

FIGS. 8A and 8B show expansions of inlet 66 and backside opening 120 in configurations without (FIG. 8A) and with (FIG. 8B) fluid flow occlusion. During normal operations (i.e., with fluid flow to flow chamber 58 not being occluded), plug 124 may be inserted in backside opening 120, as shown in FIG. 8A. Plug 124 may prevent a fluid from completely passing through inlet 66 and bypassing AICD 60. In alternative embodiments, plug 124 may be omitted, such that at least a portion of a fluid in inlet 66 bypasses AICD 60 and does not enter interior space 54 of wellbore pipe 22. When normal operations are desired, plug 124 may be chosen such that it does not occlude fluid flow through the sidewall of inlet 66 at location 122. Plug 124 may be fluidly sealed in backside opening 120 by techniques similar to those described above for plugs 70 and 80, such as O-rings, NPT, metal-to-metal connections, and the like.

As shown in FIG. 8B, elongate bar 126 may be inserted into inlet 66 from backside opening 120 and extend at least beyond location 122 so as to occlude fluid flow therethrough to AICD 60. Elongate bar 126 may be held in place within inlet 66 by plug 124. In some embodiments, elongate bar 126 may extend at least beyond location 122 but not the full length of inlet 66. In other embodiments, elongate bar 126 may extend substantially the full length of inlet 66 and terminate proximate to the entry thereof opposite that of backside opening 120. In some embodiments, plug 124 and elongate bar 126 may be discrete entities that are inserted separately into inlet 66, and in other embodiments, they may be contiguous with one another and inserted as a single elongate body. The choice of whether to occlude fluid flow through inlet 66 with elongate bar 126 may be made using similar considerations to those described above in reference to the previously depicted embodiments.

Figure 9:
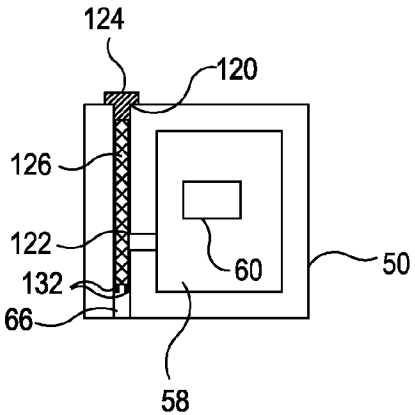
FIG. 9 shows further details of the configuration of FIG. 8B.

Further details of the configuration of FIG. 8B are shown in FIG. 9. As shown in FIG. 9, elongate bar 126 may be held in place on one end of inlet 66 with tabs 132, which are of sufficient size to impede the further movement of elongate bar 126 but not large enough to appreciably occlude fluid flow through inlet 66. Tabs 132 may allow an operator to know when elongate bar 126 has been inserted a sufficient length to extend past location 122. Elongate bar may be held in place on its other end with plug 124.

In still other embodiments, instead of occluding inlet 66 of flow control assembly 50, an exit location of AICD 60 may instead be blocked. Specifically, in some embodiments, flow control assembly 50 may be configured in such a manner that AICD 60 is radially offset from wellbore pipe 22 so as to define a fluid conduit extending between AICD 60 and wellbore pipe 22. In such embodiments, an access channel may be extended to the fluid conduit for purposes of occluding fluid flow with a longitudinally inserted elongate member, as described hereinafter.

Figure 10:
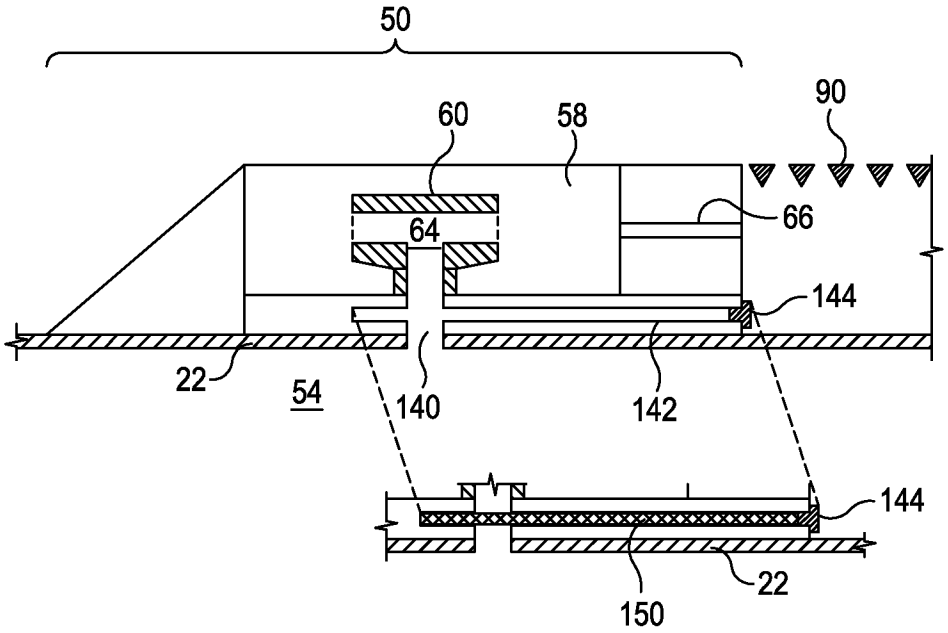
FIGS. 10 and 11 show illustrative schematics of a flow control assembly having an AICD that is radially offset therein relative to a wellbore pipe so as to define a fluid conduit extending from the AICD.
Figure 11:
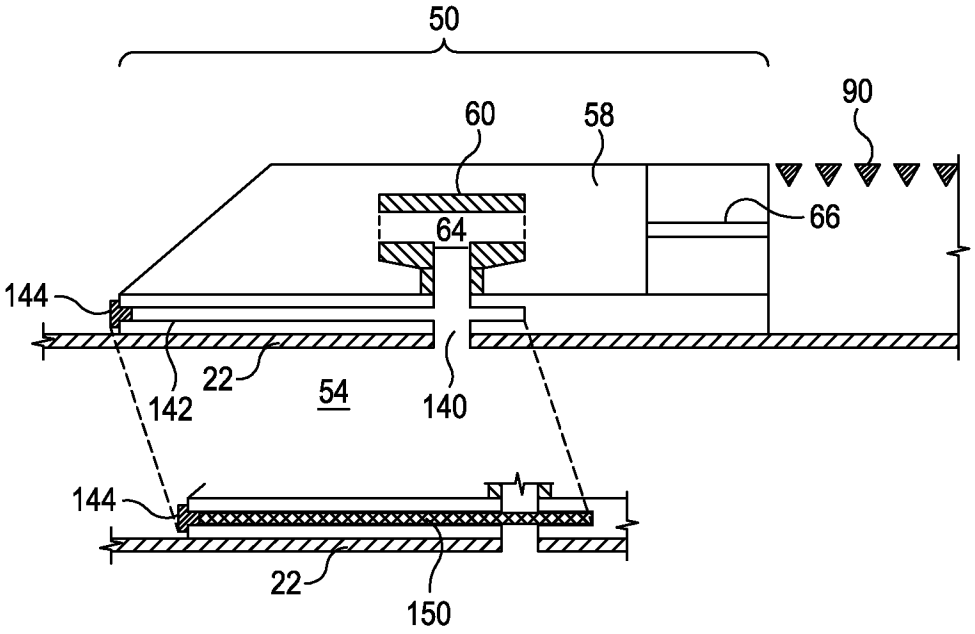

FIGS. 10 and 11 show illustrative schematics of flow control assembly 50 having AICD 60 that is radially offset therein relative to wellbore pipe 22 so as to define fluid conduit 140 extending from AICD 60. Access channel 142 may extend from a location on flow control assembly 50 to at least fluid conduit 140. In some embodiments, access channel 142 may terminate at fluid conduit 140, and in other embodiments, access channel 142 may extend past fluid conduit 140, as depicted in FIGS. 10 and 11. Access channel 142 may extend from a location upstream of AICD 60, as depicted in FIG. 10, or from a downstream location, as depicted in FIG. 11.

Under normal operating conditions (i.e., with egress of a fluid from AICD 60 not being occluded), access channel 142 may be blocked with plug 144, as depicted in FIGS. 10 and 11, while leaving fluid conduit 140 unimpeded. Plug 144 may prevent unwanted fluid loss from occurring through access channel 142 but without occluding fluid flow through fluid conduit 140. Access may be gained to insert plug 144 in the configuration of FIG. 10 as described above in reference to FIGS. 2 and 4.

When it is desired to occlude fluid flow through fluid conduit 140, elongate member 150 may be inserted therein, as depicted in phantom in FIGS. 10 and 11. Elongate member 150 may take on various forms such as, for example, a threaded rod, a screw, a plate, and the like. Elongate member 150 may further be movable within access channel 142 to expose various features thereon to fluid conduit 140, as described in greater detail below with reference to FIG. 12. Elongate member 150 may be held in place with plug 144 after its insertion into access channel 142, as depicted in FIGS. 10 and 11, or it may be held in place of its own accord without using plug 144.

Figure 12:
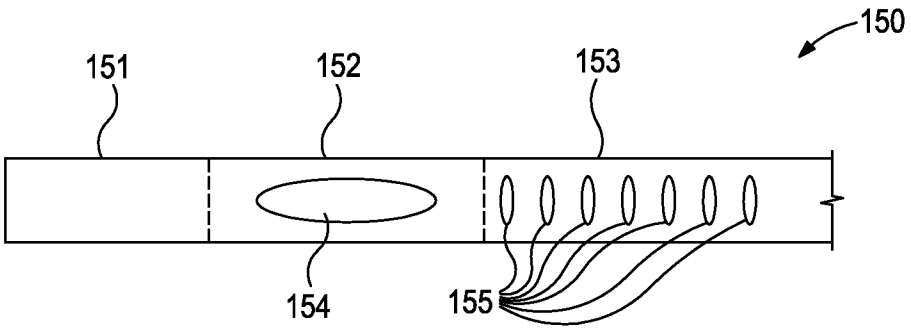
FIG. 12 shows a schematic of an illustrative elongate member with variable features thereon for differentially impeding the passage of a fluid.

FIG. 12 shows a schematic of illustrative elongate member 150 with variable features thereon for differentially impeding the passage of a fluid. By laterally moving elongate member 150 within access channel 142, the extent to which a fluid is occluded in fluid conduit 140 may be adjusted to a desired degree. As depicted in FIG. 12, elongate member 150 may have exemplary regions 151, 152 and 153, each with differential fluid occlusion properties. Region 151, with no available fluid pathway therethrough, may be used to substantially block fluid flow through fluid conduit 140. Region 152 may be moved into fluid conduit 140 to allow substantially unimpeded fluid flow through hole 154. Region 153 may be moved into fluid conduit 140 to allow partial reduction of fluid flow to take place using slotted openings 155 or like apertures, which may be of any size and shape. The number, size, shape and spacing of slotted openings 155 may be varied within region 153 so as to allow an even greater extent of fluid flow regulation to be realized.

In some embodiments, wellbore systems described herein may be configured to block fluid flow from entering an AICD. In some embodiments, wellbore systems described herein may comprise: a wellbore pipe having a flow control assembly fixedly coupled thereto, the wellbore pipe having an interior space, an outer surface, and one or more autonomous inflow control devices (AICDs) establishing a fluid connection between the interior space and the outer surface of the wellbore pipe, and the flow control assembly comprising one or more flow chambers defined on the outer surface about the one or more AICDs, one or more inlets being fluidly connected to the one or more flow chambers; wherein the one or more inlets are configured to accept a plug for occluding fluid flow therethrough, so as to limit access of a fluid to an entry location of the AICDs.

In some embodiments, one or more inlets of the wellbore systems may be configured to accept an axially inserted plug. In some or other embodiments, one or more inlets of the wellbore systems may be configured to accept a radially inserted plug.

In some embodiments, the wellbore systems may further comprise a well screen upstream of the one or more inlets that is fluidly coupled thereto, and a flow channel extending between the well screen and the one or more inlets. In some embodiments, the wellbore systems may further comprise a movable cover over at least a portion of the flow channel, such as a sliding sleeve, extending between the well screen and the flow control assembly. The movable cover, such as a sliding sleeve, may allow one to gain access to the inlets, or an access channel, if present, and insert one or more plugs therein, if desired. In some embodiments, a sliding sleeve may be configured to hold a plug in place when inserted into an inlet.

In some embodiments of the wellbore systems, the one or more inlets may extend beyond the one or more flow chambers and define one or more backside openings on the flow control assembly. The one or more backside openings are configured to accept at least one or more first plugs inserted thereto. In such embodiments, the one or more inlets may make a fluid connection to the one or more flow chambers via a sidewall of the one or more inlets. In such wellbore systems, regulation of fluid flow may take place from a direction opposite that to which a fluid is entering the flow control assembly. In some embodiments of such wellbore systems, the inlets may further comprise one or more tabs opposite the backside opening of each inlet and proximate to an entryway of each inlet. The location at which a fluid enters the flow chamber from the sidewall of the inlet may be between the tabs and the backside opening. The one or more tabs may be configured to occlude further passage of a first plug inserted into the backside opening.

In some embodiments of wellbore systems having a backside opening on the flow control assembly, the inlet may be further configured to accept a threaded second plug after a first plug, where the second plug is configured to hold the first plug in place. In some embodiments, the first plug and the threaded second plug may be distinct from one another. In other embodiments, the first plug and the threaded second plug may be contiguous with one another.

In other embodiments, wellbore systems described herein may be configured to block fluid flow from exiting an AICD. In some embodiments, wellbore systems described herein may comprise: a wellbore pipe having a flow control assembly fixedly coupled thereto, the wellbore pipe having an interior space, an outer surface, and one or more AICDs establishing a fluid connection between the interior space and the outer surface of the wellbore pipe, and the flow control assembly comprising one or more flow chambers defined on the outer surface about the one or more AICDs, one or more inlets being fluidly connected to the one or more flow chambers; and one or more access channels of the flow control assembly that each intersect a fluid conduit extending between each AICD and the interior space of the wellbore pipe, the one or more access channels each containing a movable elongate member configured to occlude fluid flow through the fluid conduits.

In some embodiments of such wellbore systems, the movable elongate member extends from an end of the flow control assembly to at least the fluid conduit. In other embodiments, the movable elongate member may extend from an end of the flow control assembly to a location beyond the fluid conduit. In more particular embodiments, the movable elongate member may have one or more openings therein.

As mentioned above, the wellbore systems disclosed herein may be used in conjunction with producing a fluid from a wellbore. More particularly, the wellbore systems may be readily configured on-site to alter the fluid flow characteristics offered by a fixed configuration of AICDs in a flow control assembly. Conducting on-site configuration of the AICDs may be much more efficient than custom manufacturing a flow control assembly with a desired number and configuration of AICDs. The opportunity to readily modify the performance of one or more AICDs in the field may allow decreased production costs to be realized. Moreover, by having the opportunity to modify flow characteristics in the field, an operator may be able to more proactively respond to unexpected conditions that may be encountered after drilling and logging a formation.

Any of the wellbore systems described herein or any combination thereof may be used in conjunction with producing a fluid from a wellbore penetrating a subterranean formation. In some embodiments, wellbore systems having a plurality of flow control assemblies disposed in series with one another and in fluid communication with a wellbore pipe may be used to separately produce a fluid from one or more intervals of a formation. The wellbore systems may also be used in injection operations, which may or may not precede a production operation.

In some embodiments, methods described herein may comprise: attaching a flow control assembly to a wellbore pipe having an interior space and an outer surface, such that fluid coupling to the interior space of the wellbore pipe takes place via the flow control assembly and one or more AICDs on the wellbore pipe, one or more inlets of the flow control assembly being fluidly connected to one or more flow chambers defined on the outer surface about the one or more AICDs; inserting a plug into one or more inlets; placing the wellbore pipe and flow control assembly in a wellbore penetrating a subterranean formation; and producing a fluid from the subterranean formation via the wellbore pipe.

In some embodiments, the methods may further comprise determining a composition of a fluid phase located in the subterranean formation prior to inserting a plug into one or more inlets. By knowing the fluid composition, a well operator can make a decision about how to most effectively alter the flow characteristics of a wellbore system of the present disclosure.

In some embodiments, the plug may be inserted radially into one or more inlets. In some or other embodiments, the plug may be inserted axially into one or more inlets. In some embodiments, a plug may be inserted axially into one or more inlets from a location between the flow control assembly and a well screen that is fluidly coupled to an entry of the one or more fluid entry conduits. In other embodiments, a plug may be inserted axially into one or more inlets from a location opposite that to which a fluid enters the inlets. In various embodiments, a plug may be inserted into one or more inlets prior to placing the wellbore pipe and flow control assembly in the wellbore.

In some embodiments, at least a first plug may be inserted into one or more inlets from one or more backside openings on a flow control assembly. In some such embodiments, at least a portion of the first plugs may occlude fluid flow from one or more inlets to an AICD. In some embodiments, at least a portion of the first plugs may be held in place by a threaded second plug that is also inserted in the backside opening.

In some embodiments, methods described herein may comprise: attaching a flow control assembly to a wellbore pipe having an interior space and an outer surface, such that fluid coupling to the interior space of the wellbore pipe takes place via the flow control assembly and one or more AICDs on the wellbore pipe, an inlet of the flow control assembly being fluidly connected to one or more flow chambers defined on the outer surface about the one or more AICDs; wherein the flow control assembly comprises one or more access channels that each intersect a fluid conduit extending between each AICD and the interior of the wellbore pipe; positioning a movable elongate member in the access channels, at least a portion of each movable elongate member being configured to occlude fluid flow through the fluid conduits; placing the wellbore pipe and flow control assembly in a wellbore penetrating a subterranean formation; and producing a fluid from the subterranean formation via the wellbore pipe. In some embodiments, the methods may further comprise inserting the movable elongate member in at least a portion of the access channels. In some embodiments, the movable elongate member may extend from an end of the flow control assembly to a location beyond the fluid conduit.

Embodiments disclosed herein include:

A. Wellbore systems configured for adjusting fluid flow therethrough. The wellbore systems comprise: a wellbore pipe having a flow control assembly fixedly coupled thereto, the wellbore pipe having an interior space, an outer surface, and one or more autonomous inflow control devices (AICDs) establishing a fluid connection between the interior space and the outer surface of the wellbore pipe, and the flow control assembly comprising one or more flow chambers defined on the outer surface about the one or more AICDs, one or more inlets being fluidly connected to the one or more flow chambers; wherein the one or more inlets are configured to accept a plug for occluding fluid flow therethrough, so as to limit access of a fluid to an entry location of the AICDs.

B. Methods for regulating fluid flow through a wellbore system. The methods comprise: attaching a flow control assembly to a wellbore pipe having an interior space and an outer surface, such that fluid coupling to the interior space of the wellbore pipe takes place via the flow control assembly and one or more AICDs on the wellbore pipe, one or more inlets of the flow control assembly being fluidly connected to one or more flow chambers defined on the outer surface about the one or more AICDs; inserting a plug into one or more inlets; placing the wellbore pipe and flow control assembly in a wellbore penetrating a subterranean formation; and producing a fluid from the subterranean formation via the wellbore pipe.

C. Wellbore systems configured for adjusting fluid flow therethrough. The wellbore systems comprise: a wellbore pipe having a flow control assembly fixedly coupled thereto, the wellbore pipe having an interior space, an outer surface, and one or more AICDs establishing a fluid connection between the interior space and the outer surface of the wellbore pipe, and the flow control assembly comprising one or more flow chambers defined on the outer surface about the one or more AICDs, one or more inlets being fluidly connected to the one or more flow chambers; and one or more access channels of the flow control assembly that each intersect a fluid conduit extending between each AICD and the interior space of the wellbore pipe, the one or more access channels each containing a movable elongate member configured to occlude fluid flow through the fluid conduits.

D. Methods for regulating fluid flow through a wellbore system. The methods comprise: attaching a flow control assembly to a wellbore pipe having an interior space and an outer surface, such that fluid coupling to the interior space of the wellbore pipe takes place via the flow control assembly and one or more AICDs on the wellbore pipe, an inlet of the flow control assembly being fluidly connected to one or more flow chambers defined on the outer surface about the one or more AICDs; wherein the flow control assembly comprises one or more access channels that each intersect a fluid conduit extending between each AICD and the interior of the wellbore pipe; positioning a movable elongate member in the access channels, at least a portion of each movable elongate member being configured to occlude fluid flow through the fluid conduits; placing the wellbore pipe and flow control assembly in a wellbore penetrating a subterranean formation; and producing a fluid from the subterranean formation via the wellbore pipe.

Each of embodiments A and B may have one or more of the following additional elements in any combination:

Element 1: wherein one or more inlets are configured to accept an axially inserted plug.

Element 2: wherein one or more inlets are configured to accept a radially inserted plug.

Element 3: wherein the wellbore systems further comprise a well screen upstream of the one or more inlets that is fluidly coupled thereto, and a flow channel extending between the well screen and the one or more inlets.

Element 4: wherein the wellbore systems further comprise a movable cover located over at least a portion of the flow channel.

Element 5: wherein the movable cover is a sliding sleeve.

Element 6: wherein the sliding sleeve is configured to hold a plug in place when the plug inserted is into an inlet.

Element 7: wherein the one or more inlets extend beyond the one or more flow chambers and define one or more backside openings on the flow control assembly, and wherein the one or more backside openings are configured to accept at least one or more first plugs inserted thereto.

Element 8: wherein the one or more inlets make a fluid connection to the one or more flow chambers via a sidewall of the one or more inlets.

Element 9: wherein the wellbore systems further comprise one or more tabs located opposite the backside opening of each inlet and proximate to an entryway of each inlet, the one or more tabs being configured to occlude further passage of a first plug inserted in a backside opening.

Element 10: wherein the backside opening of each inlet is further configured to accept a threaded second plug after a first plug, the threaded second plug being configured to hold the first plug in place.

Element 11: wherein the first plug and the threaded second plug are contiguous with one another.

Element 12: wherein the methods further comprise determining a composition of a fluid located in the subterranean formation prior to inserting a plug into one or more inlets.

Element 13: wherein a plug is inserted radially into one or more inlets.

Element 14: wherein a plug is inserted axially into one or more inlets.

Element 15: wherein a plug is inserted axially into one or more inlets from a location between the flow control assembly and a well screen that is fluidly coupled to an entry of the one or more inlets.

Element 16: wherein at least a portion of the first plugs occlude fluid flow from one or more inlets to an AICD.

Element 17: wherein at least a portion of the first plugs are held in place by a threaded second plug that is also inserted into a backside opening.

Element 18: wherein a plug is inserted into one or more inlets prior to placing the wellbore pipe and flow control assembly in the wellbore.

Element 19: wherein the methods further comprise injecting a fluid into the subterranean formation by the wellbore pipe, such that the fluid being injected flows from the wellbore pipe through the flow control assembly in a direction opposite to that of the fluid being produced.

Each of embodiments C and D may have one or more of the following additional elements in any combination:

Element 20: wherein the movable elongate member extends from an end of the flow control assembly to at least the fluid conduit.

Element 21: wherein the movable elongate member extends from an end of the flow control assembly to a location beyond the fluid conduit.

Element 22: wherein the movable elongate member has one or more openings therein.

Element 23: wherein the methods further comprise inserting the movable elongate member in at least a portion of the access channels.

Certain elements applicable to embodiments A and B may also be applicable to embodiments C and D.

By way of non-limiting example, exemplary combinations applicable to A, B, C and D include:

Combination 1: The wellbore system of A in combination with elements 1 and 2.

Combination 2: The wellbore system of A in combination with elements 1 and 3.

Combination 3: The wellbore system of A in combination with elements 1, 3 and 4.

Combination 4: The wellbore system of A in combination with elements 1, 3, 4, 5 and 6.

Combination 5: The wellbore system of A in combination with elements 7 and 8.

Combination 6: The wellbore system of A in combination with elements 7, 8 and 9.

Combination 7: The wellbore system of A in combination with elements 7, 8 and 10.

Combination 8: The wellbore system of A in combination with elements 3 and 7.

Combination 9: The method of B in combination with elements 3 and 13.

Combination 10: The method of B in combination with elements 14 and 15.

Combination 11: The method of B in combination with elements 3, 14 and 15.

Combination 12: The method of B in combination with elements 3, 4, 5 and 15.

Combination 13: The wellbore system of C in combination with elements 20 and 22.

Combination 14: The wellbore system of C in combination with elements 21 and 22.

Combination 15: The wellbore system of C in combination with elements 3 and 20.

Combination 16: The wellbore system of C in combination with elements 3 and 21.

Combination 17: The method of D in combination with elements 20 and 23.

Combination 18: The method of D in combination with elements 21 and 23.

Combination 19: The method of D in combination with elements 19 and 23.

Combination 20: The method of D in combination with elements 19 and 23.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The embodiments illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is the following:

1. A wellbore system comprising:

a wellbore pipe having a flow control assembly fixedly coupled thereto, the wellbore pipe having an interior space, an outer surface, and one or more autonomous inflow control devices (AICDs) establishing a fluid connection between the interior space and the outer surface of the wellbore pipe, and the flow control assembly comprising one or more flow chambers defined on the outer surface about the one or more AICDs, one or more inlets being fluidly connected to the one or more flow chambers;

wherein the one or more inlets are configured to each accept a plug for occluding fluid flow therethrough, so as to limit access of a fluid to an entry location of the one or more AICDs; and a movable cover slidably coupled to the flow control assembly to selectively engage each plug within a corresponding inlet of the one or more inlets.

2. The wellbore system of claim 1, wherein each plug comprises an axially inserted plug.

3. The wellbore system of claim 1, wherein each plug comprises a radially inserted plug.

4. The wellbore system of claim 1, further comprising:

a well screen upstream of the one or more inlets that is fluidly coupled thereto; and a flow channel extending between the well screen and the one or more inlets.

5. The wellbore system of claim 4, wherein the movable cover is located over at least a portion of the flow channel.

6. The wellbore system of claim 5, wherein the movable cover is a sliding sleeve.

7. The wellbore system of claim 6, wherein the sliding sleeve is configured to hold each plug in place when each plug inserted is into the corresponding inlet.

8. The wellbore system of claim 1, wherein the one or more inlets extend beyond the one or more flow chambers and define one or more backside openings on the flow control assembly;

wherein the one or more backside openings are configured to accept at least one or more first plugs inserted thereto.

9. The wellbore system of claim 8, wherein the one or more inlets make a fluid connection to the one or more flow chambers via a sidewall of the one or more inlets.

10. The wellbore system of claim 8, further comprising:

one or more tabs located opposite a corresponding backside opening of the one or more backside openings of each inlet and proximate to an entryway of each inlet, the one or more tabs being configured to occlude further passage of a first plug of the one or more plugs inserted in the corresponding backside opening of the corresponding inlet.

11. The wellbore system of claim 10, wherein the backside opening of each inlet is further configured to accept a threaded second plug after the first plug, the threaded second plug being configured to hold the first plug in place.

12. The wellbore system of claim 11, wherein the first plug and the threaded second plug are contiguous with one another.

13. A method comprising:

attaching a flow control assembly to a wellbore pipe having an interior space and an outer surface, such that fluid coupling to the interior space of the wellbore pipe takes place via the flow control assembly and one or more autonomous inflow control devices (AICDs) on the wellbore pipe, one or more inlets of the flow control assembly being fluidly connected to one or more flow chambers defined on the outer surface about the one or more AICDs;

inserting a plug into each of the one or more inlets by slidably moving a cover coupled to the flow control assembly to selectively engage each plug within a corresponding inlet of the one or more inlets;

placing the wellbore pipe and flow control assembly in a wellbore penetrating a subterranean formation; and producing a fluid from the subterranean formation via the wellbore pipe.

14. The method of claim 13, further comprising:

determining a composition of a fluid located in the subterranean formation prior to inserting each plug into the one or more inlets.

15. The method of claim 13, wherein each plug is inserted radially into one or more inlets.

16. The method of claim 13, wherein each plug is inserted axially into the corresponding inlet of the one or more inlets.

17. The method of claim 16, wherein each plug is inserted axially into the corresponding inlet of the one or more inlets from a location between the flow control assembly and a well screen that is fluidly coupled to an entry of the one or more inlets.

18. The method of claim 13, wherein the one or more inlets extend beyond the one or more flow chambers and define one or more backside openings on the flow control assembly;

wherein one or more first plugs of the one or more plugs are inserted into one or more inlets from the one or more backside openings.

19. The method of claim 18, wherein at least a portion of the first plugs occlude fluid flow from the one or more inlets to the one or more AICDs.

20. The method of claim 19, wherein at least a portion of the one or more first plugs are held in place by a threaded second plug that is also inserted into one of the backside openings.

21. The method of claim 13, wherein each plug is inserted into each of the one or more inlets prior to placing the wellbore pipe and flow control assembly in the wellbore.

22. The method of claim 13, further comprising:

injecting a fluid into the subterranean formation by the wellbore pipe, such that the fluid being injected flows from the wellbore pipe through the flow control assembly in a direction opposite to that of the fluid being produced.

* * * * *